US006186497B1

(12) United States Patent
Johnston

(10) Patent No.: US 6,186,497 B1
(45) Date of Patent: Feb. 13, 2001

(54) LOW COST MULTIPLE OUTPUT SHEET INVERTER

(75) Inventor: Donald E. Johnston, Rochester, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/365,389

(22) Filed: Aug. 2, 1999

(51) Int. Cl.[7] ..... B65H 29/00; B65H 7/02; B65H 29/54

(52) U.S. Cl. ..... 271/186; 271/304; 271/258.01; 271/258.02; 271/902

(58) Field of Search ..... 271/186, 303, 271/304 C, 305, 65, 258.02 E, 265.01 C, 902 C

(56) References Cited

U.S. PATENT DOCUMENTS 4,579,326 * 4/1986 Pickney et al. ..... 271/3.1 X
4,699,367 * 10/1987 Russel ..... 271/65 X
4,714,241 * 12/1987 Randall ..... 271/3.1
5,131,649 7/1992 Martin et al. ..... 271/302
5,265,864 11/1993 Roux et al. ..... 271/186
5,374,049 12/1994 Bares et al. ..... 271/186
5,513,840 * 5/1996 Fujita et al. ..... 271/301 X
5,655,765 * 8/1997 Asami et al. ..... 271/185 X
5,887,868 * 3/1999 Lambert et al. ..... 271/186
6,042,098 * 3/2000 Kubota et al. ..... 271/58.02

* cited by examiner

*Primary Examiner*—Christopher P. Ellis
*Assistant Examiner*—Kenneth W Bower
(74) *Attorney, Agent, or Firm*—William A. Henry, II; William F. Eipert

(57) ABSTRACT

A low cost inverter apparatus of includes a dual positionable, multi-function gate and a stationary baffle that guides sheets toward catch or output trays or work in conjunction with reversible rolls to direct the sheets into a duplex path. The dual positionable gate and stationary baffle have points thereon that are positioned to use the beam strength of the sheets to align the sheets with a duplex nip that feeds the sheet into the duplex path.

8 Claims, 6 Drawing Sheets

LOW COST MULTIPLE OUTPUT SHEET INVERTER

BACKGROUND OF THE INVENTION

1. Field of the Invention

The present invention relates to improvements in printer/copier architecture including a multiple output inverter that serves to interchange the trail edge of a sheet as the lead edge and interchanging the top side of a sheet with the bottom side of the sheet by employing a unique gating system.

2. Description of the Related Art

Inverters are used in copiers to enable automatic duplex as color highlighting copying or printing. The main function of an inverter is to interchange the trail edge of a sheet as the lead edge of the sheet and interchange the top side of a sheet with the bottom side of the sheet.

Many prior art printer/copier machines also include gating devices. Such gating devices include at least one removable guide at a crossroad for directing a sheet into a number of paper paths. Gates do not invert copy sheets, rather they serve to direct sheets to a desired path.

Many prior machines employ at least one inverter, as well as, multiple gating stations. However, this structure is cumbersome and require extraneous paper paths.

PRIOR ART

Present inverters that may be relevant include:

U.S. Pat. No. 5,374,049 which discloses an inverter system that includes multiple gates.

U.S. Pat. No. 5,131,649 discloses a multiple output inverter that employs a sheet pocket with a first end and a second end with rollers spaced a predetermined distance from the first end. The sheet pocket includes a plurality of sheet feeding nips with one of the nips being an inlet nip for directing a sheet into the first end of the sheet pocket and at least one other of the nips being an exit nip for directing a sheet out of the first end the sheet pocket, and bypass for selectively permitting a sheet to exit the sheet pocket through the second end thereof.

A tri-roll inverter is shown in U.S. Pat. No. 5,265,864 that includes a sheet corrugating nip and an output baffle at the corrugation nip with raised edges which contributes to corrugation of copy sheets driven out of the corrugation nip.

The present invention aims at providing a low cost inverter with a multi-function decision gate that directs output copy to a plurality of top side exit trays and a duplex path.

SUMMARY OF THE INVENTION

Accordingly, in accordance with the purposes of the present invention, as embodied and broadly described herein, the low cost inverter apparatus of the present invention includes a dual positionable, multi-function gate and a stationary baffle that guide sheets toward catch or output trays or work in conjunction with reversible rolls to direct the sheets into a duplex path. The dual positionable gate and stationary baffle have points thereon that are positioned to use the beam strength of the sheets to align the sheets with a duplex nip that feeds the sheets into the duplex path.

The accompanying drawings, which are incorporated in and constitute a part of this specification, illustrate a preferred embodiment of the present invention and together with the description, serve to explain the principles of the invention.

DESCRIPTION OF THE PREFERRED EMBODIMENT

Figure 1:
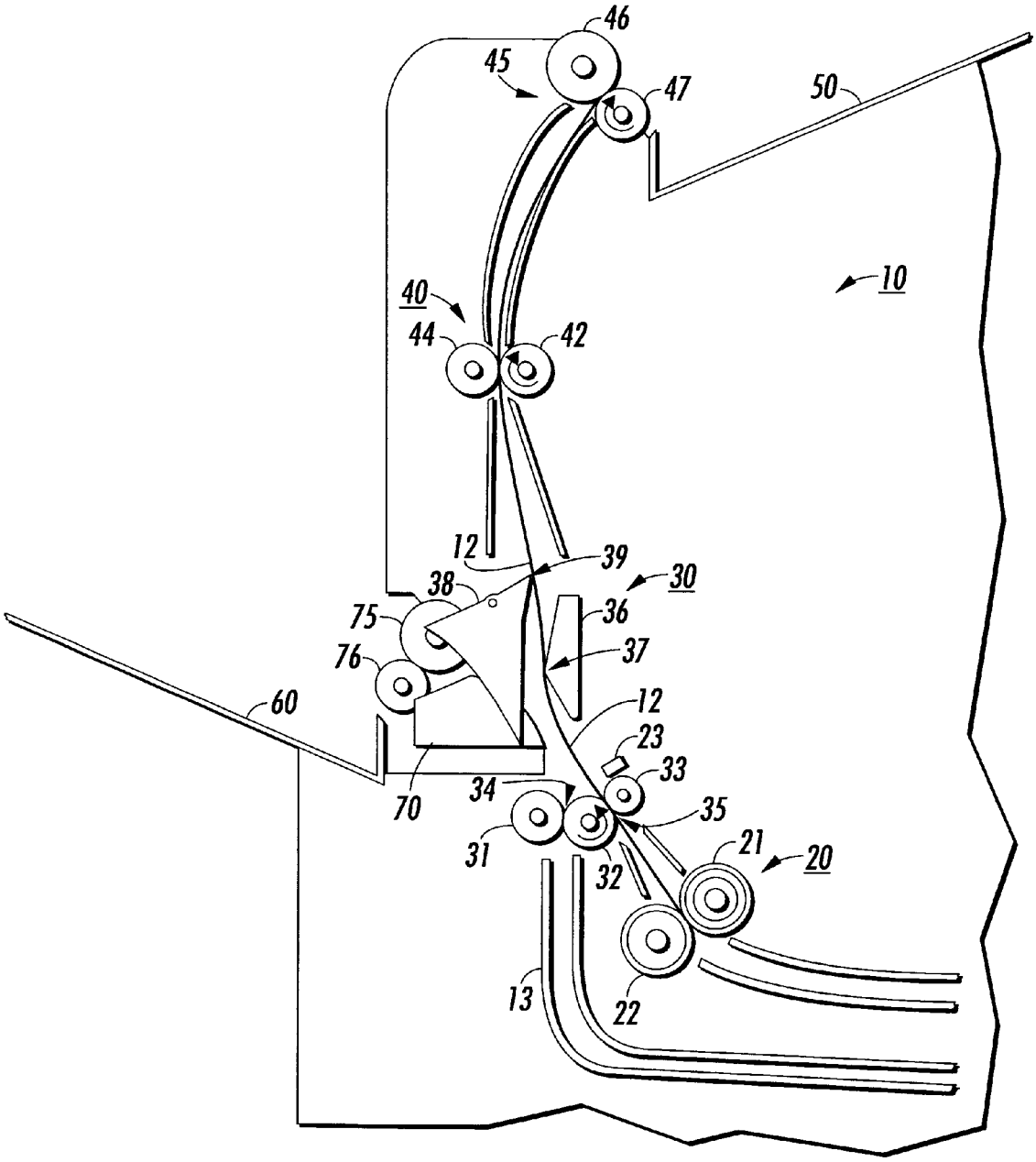
FIG. 1 is a schematic diagram of a low cost inverter employing a multi-function gate in accordance with the present invention showing a sheet being guided to a top output tray of a printer.

Reference will now be made in detail to the present preferred embodiment of the invention, an example of which is illustrated in the accompanying drawings. Whenever possible, the same reference numerals are used throughout the drawings to refer to the same or like parts.

Figure 2:
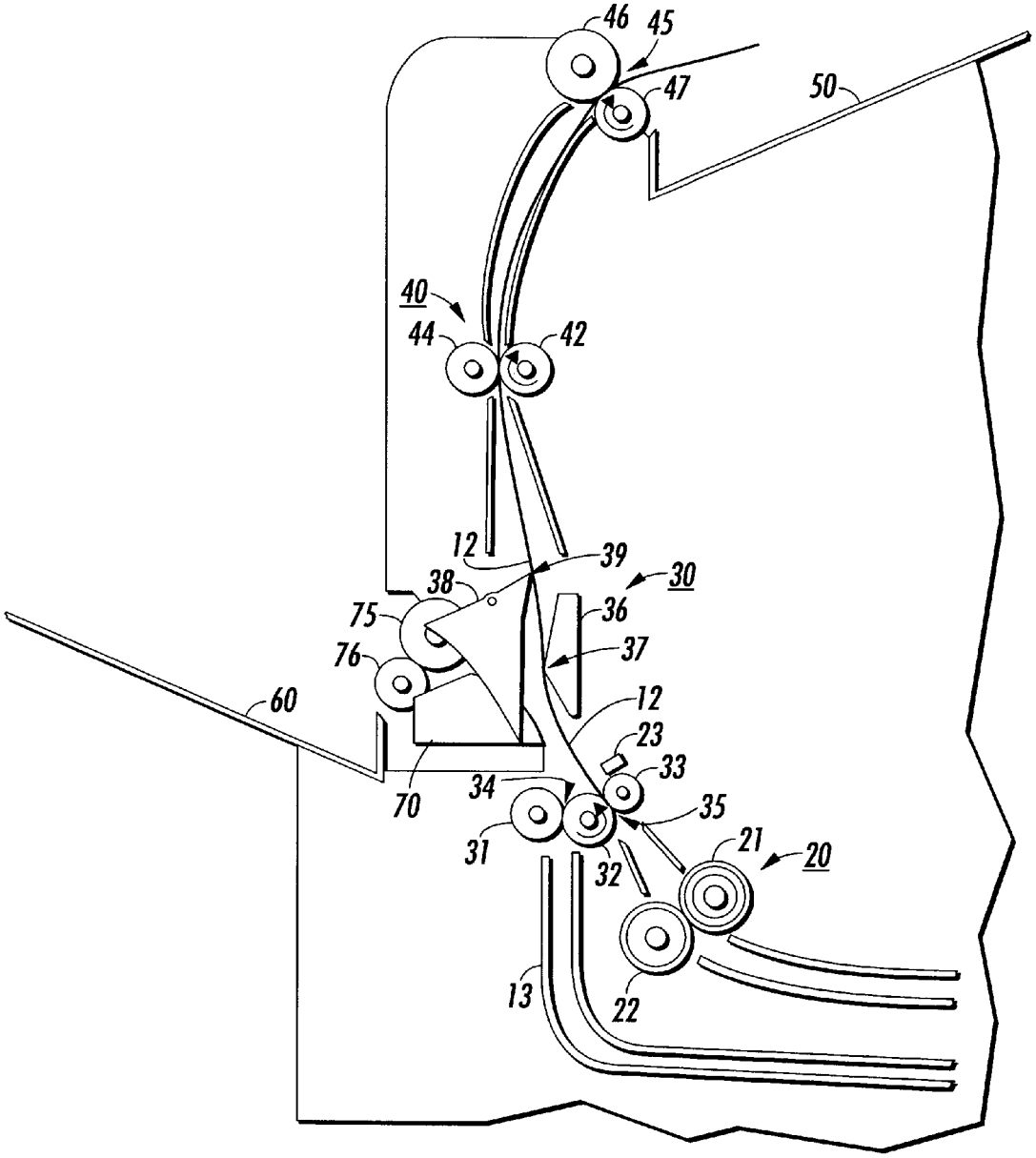
FIG. 2 is a schematic diagram of the low cost inverter of FIG. 1 showing a sheet in a nip of a tri-roll device and a sheet reversible roll nip en route to a top output tray.

In accordance with the present invention, there is provided in FIG. 1 a partial schematic of a printer 10 that includes a fuser 20 having a fusing roll 21 and a backup roll 22. An inverter 30 is downstream from fuser 20 and has tri-rolls 31, 32 and 33 that form nips 34 and 35. Downstream of the tri-rolls is positioned a right side baffle 36 and a multi-function decision gate 38 that enables multiple paper paths using mechanical deflection and geometry of baffle 36. A reversible drive nip 40 is positioned downstream of the tri-rolls and includes a reversible drive roll 42 and an idler roll 44. Clockwise rotation of reversible drive roll 42 moves a sheet 12 into reversible exit nip 45 that includes a drive roll 47 and an idler roll 46 which when activated in a clockwise direction moves sheet 12 into output tray 50. In FIG. 2, sheet 12 is shown partially controlled by tri-roll nip 35, reversible drive roll nip 40 and reversible exit nip 45.

Figure 3:
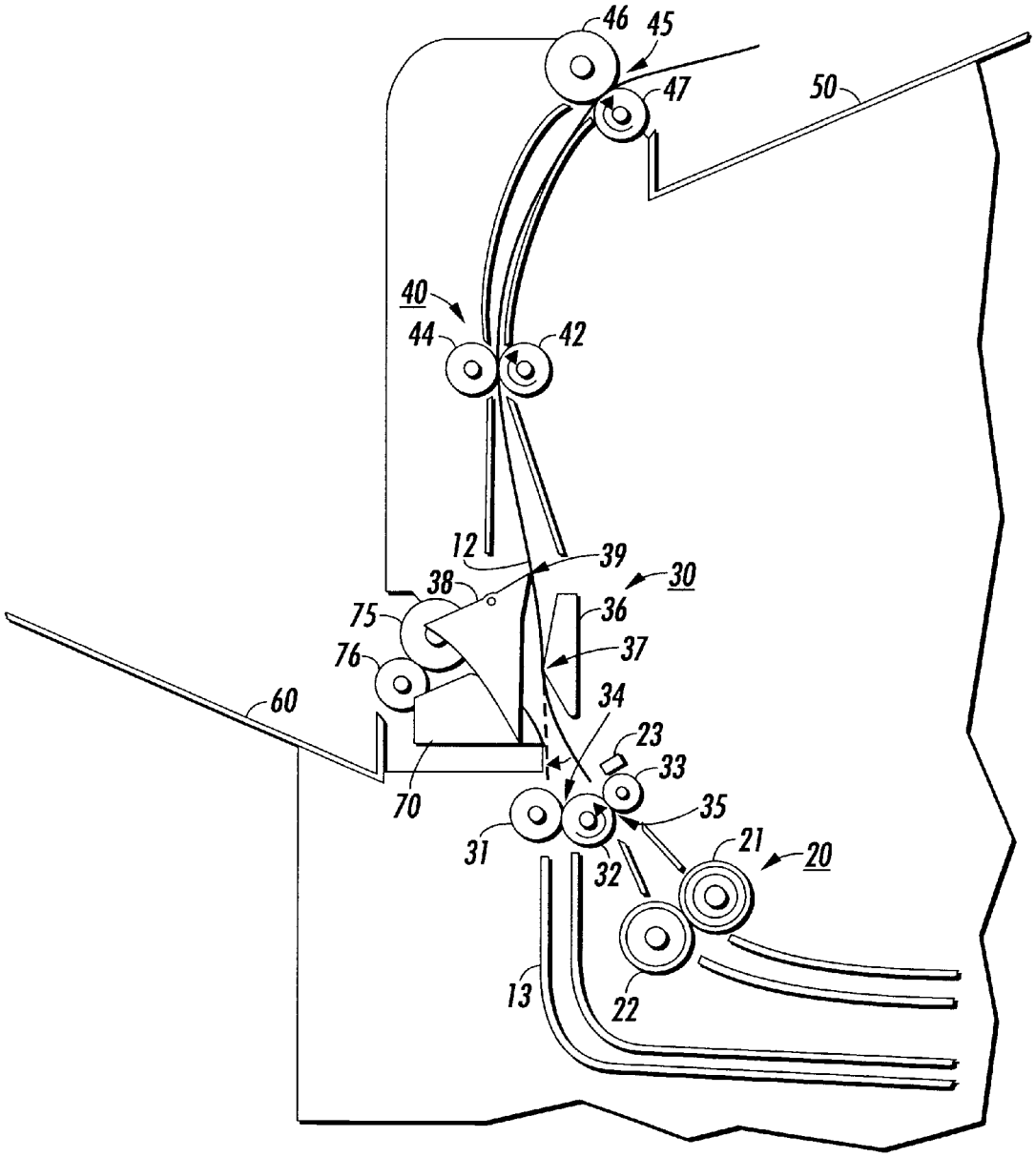
FIG. 3 is a schematic diagram of the low cost inverter of FIG. 1 showing a sheet leaving a tri-roll nip and snapping over to align with a duplex path.

As shown in FIG. 3, if duplexing of a sheet is required, the sheet must be moved into a duplex path as indicated by chute 13. In order to accomplish this, baffle 36 has a portion thereof that corresponds to a point at 37 that extends into the path of sheet 12 as it is conveyed toward reversible drive nip 40 and bends the sheet in a first direction in order to increase the beam strength of the sheet. A portion of decision gate 38 comes to a point at 39 in order to bend sheet 12 into a second direction counter to the first direction in order to put a reverse bend into the sheet and further increase the beam strength of the sheet. As a result, after the sheet leaves tri-roll nip 35, the increased beam strength of the sheet causes its tail end to snap over and align with tri-roll nip 34 through which the sheet is driven back into printer 10 in the through chute 13 for printing on the opposite side thereof. A fuser exit sensor 23 is positioned downstream of fuser 20 and senses the trail edges of the sheet and this signal is used to time the reversible exit nip 45 formed by drive roll 46 and idler roll 47 to drive this trail edge of the sheet into nip 34.

Figure 4:
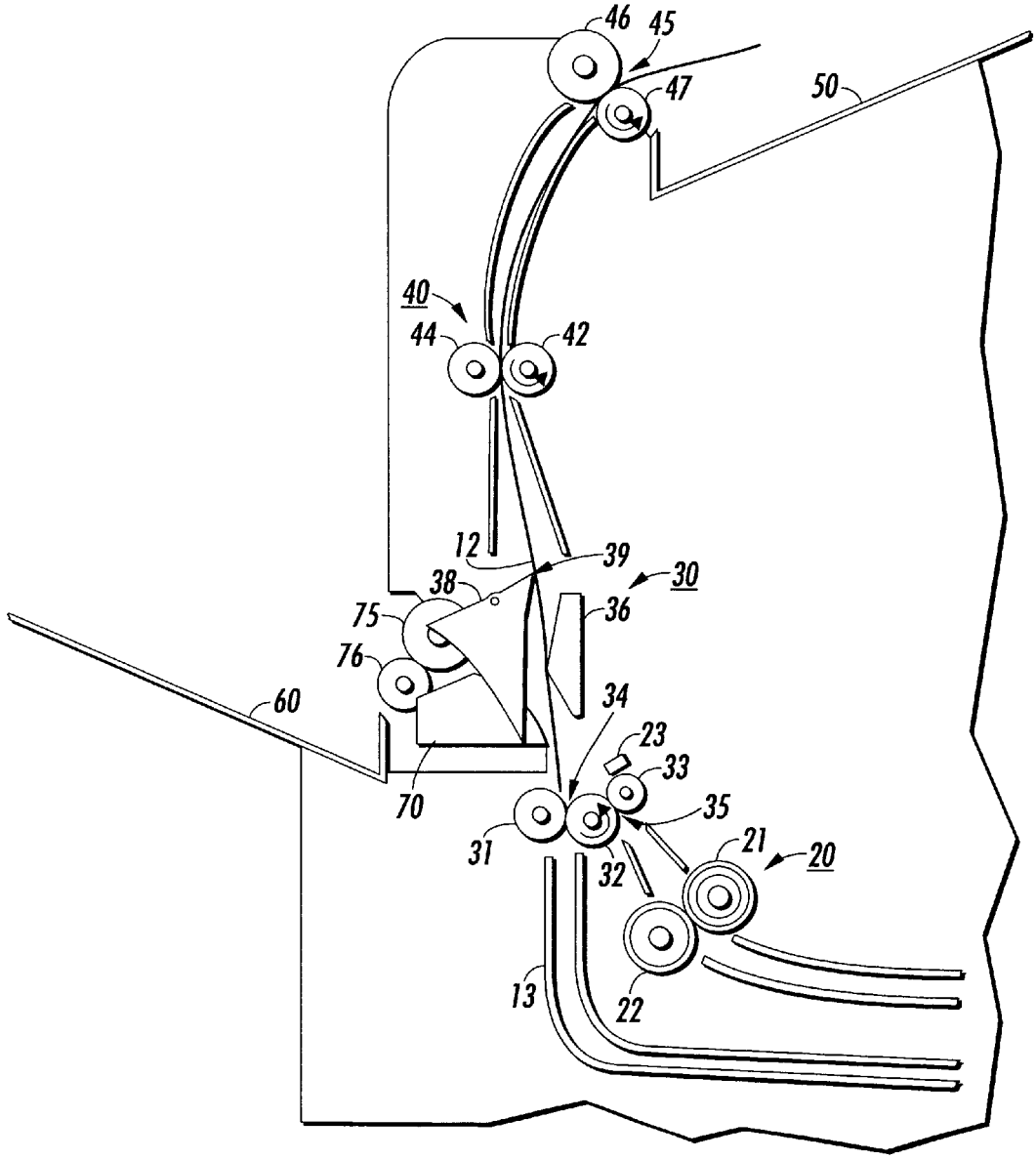
FIG. 4 is a schematic diagram of the low cost inverter of FIG. 1 showing a reversible nip driving a sheet into the duplex path.
Figure 5:
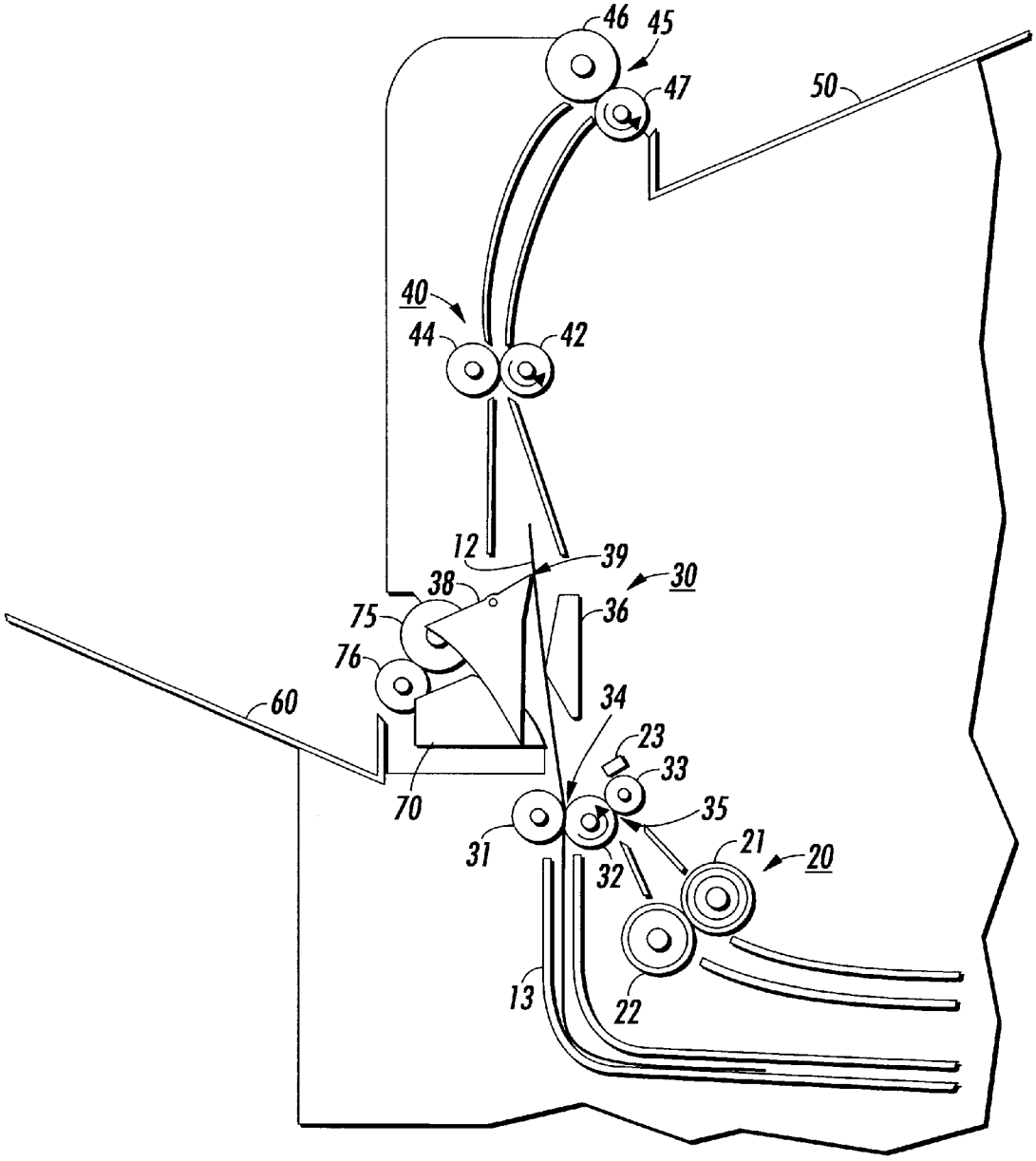
FIG. 5 is a schematic diagram of the low cost inverter of FIG. 1 showing a sheet in the duplex path.

In FIG. 4, sheet 12 is shown being driven by reversible drive nip 40 toward tri-roll nip 34 and in FIG. 5 the sheet is shown under control of nip 34 and driven into chute 13 for duplexing purposes.

Figure 6:
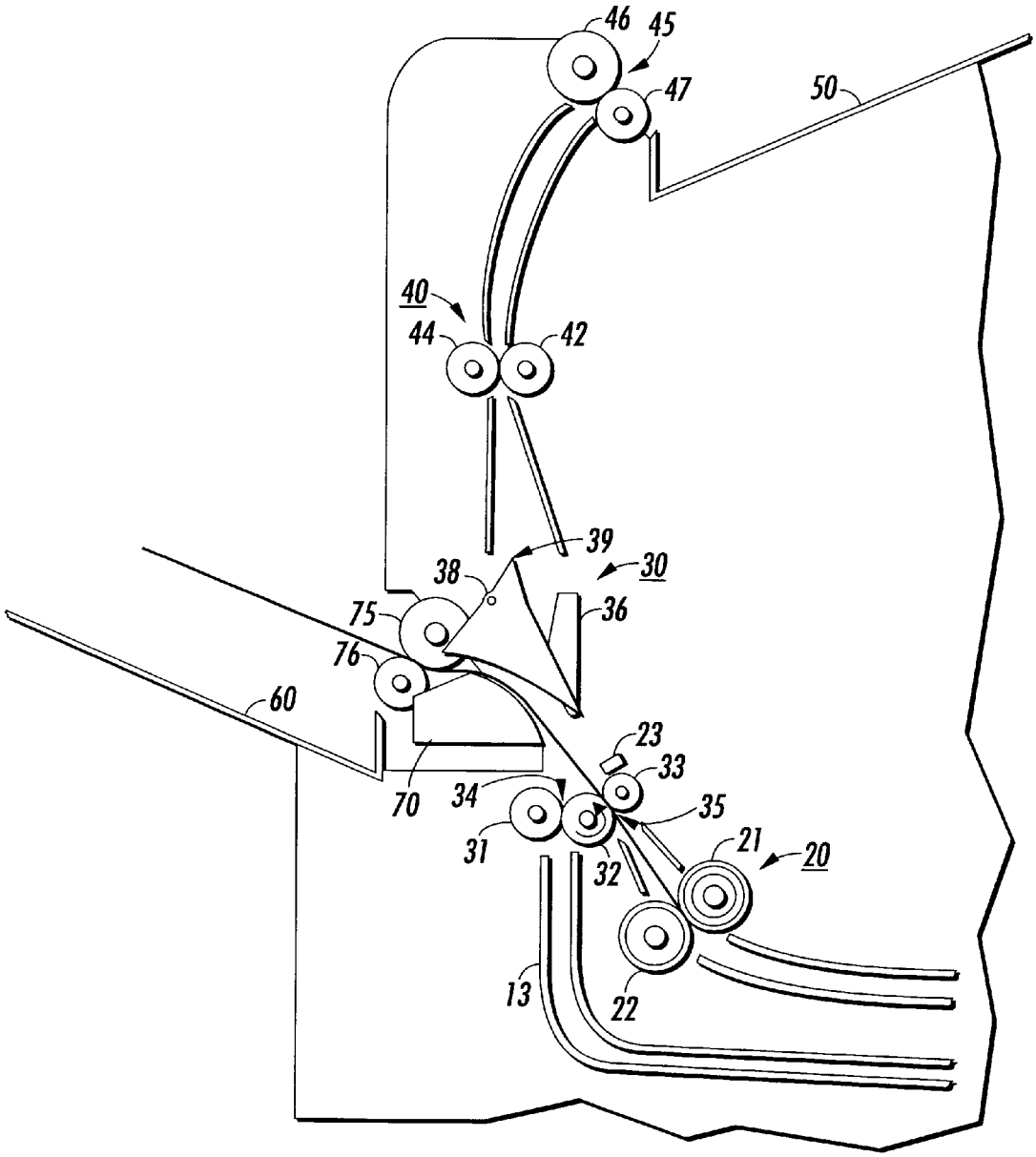
FIG. 6 is a schematic diagram of the low cost of inverter of FIG. 1 showing a sheet being guided into a side output tray.

Multi-function decision gate 38 is actuated by a solenoid (not shown) when directing of sheet 12 into side exit tray 60 is required as shown in FIG. 6. Gate 38 is moved, once actuated from a stationary position, to the position shown in FIG. 6 with a curved surface thereof guiding a sheet 12 fed from tri-roll nip 35 along with curved surfaces of the gate 38 and an adjacent baffle 70 along the curved surface into side exit tray 60 with the help of output rolls 75 and 76.

It should now be apparent that a low cost inverter having a multi-function decision gate has been disclosed that enables multiple paper paths for sheets travelling within a printer. The normal position of the gate directs sheets to a top exit tray while a second position of the gate directs a sheet into a side exit tray. Sheets are directed into the duplex path with the gate in the normal position due to the unique geometry of the gate along with the beam strength of the sheets.

Other embodiments of the invention will be apparent to those skilled in the art from consideration of the specification and practice of the invention disclosed herein. It is intended that the specification and examples be considered only with the true scope and spirit of the invention being indicated the following claims:

What is claimed is:

1. An inverter apparatus, comprising:

a multi-positionable gate;

a baffle positioned opposite said multi-positionable gate to form a sheet path therebetween;

a first nip for driving a sheet towards said multi-positionable gate;

a second nip for driving a sheet away from said multi-positionable gate; and a reversible drive nip for driving a sheet away from or towards said multi-positionable gate, and wherein said multi-positionable gate and said baffle include a protruding portion thereon that bend sheets passing thereover in opposite directions.

2. The inverter apparatus of claim 1, including a reversible exit nip for driving sheets into an output tray or towards said multi-positionable gate.

3. The inverter apparatus of claim 2, including a sensor for sensing a trail edge of a sheet passing thereover.

4. The inverter apparatus of claim 3, wherein said sensor sends a signal to actuate said second reversible drive nip in a reverse direction once the trail edge of a sheet is sensed.

5. An inverter apparatus, comprising:

a multi-positionable gate;

a baffle positioned opposite said multi-positionable gate to form a sheet path therebetween;

a reversible drive roll and an idler roll forming a first nip and positioned downstream of said multi-positionable gate for driving a sheet away from or towards said multi-positionable gate;

a second reversible drive roll and an idler roll forming a second nip downstream of said first nip and positioned for driving a sheet away from or towards said multi-positionable gate; and a tri-roll device including multiple nips for driving a sheet away from or towards said multi-positionable gate, and wherein said multi-positionable gate and said baffle include a protruding portion thereon that bend sheets passing thereover in opposite directions.

6. The inverter apparatus of claim 5, including a sensor for sensing a trail edge of a sheet passing thereover.

7. The inverter apparatus of claim 6, wherein said sensor sends a signal to actuate said first and second nips to rotate in a reverse direction once the trail edge of a sheet is sensed.

8. An inverter apparatus, comprising:

a multi-positionable gate;

a baffle positioned opposite said multi-positionable gate to form a sheet path therebetween;

a reversible drive roll and an idler roll forming a first nip and positioned downstream of said multi-positionable gate for driving a sheet away from or towards said multi-positionable gate;

a second reversible drive roll and an idler roll forming a second nip downstream of said first nip and positioned for driving a sheet away from or towards said multi-positionable gate;

a tri-roll device including multiple nips for driving a sheet away from or towards said multi-positionable gate, and wherein said multi-positionable gate and said baffle include a protruding portion thereon that bend sheets passing thereover in opposite directions; and a sensor positioned downstream of said tri-roll device for sensing a trail edge of a sheet as the sheet exits one of said multiple nips of said tri-roll device en route towards said multi-positionable gate, said sensor being adapted to send a signal to actuate said first and second nips to rotate in a reverse direction once the trail edge of a sheet is sensed.

* * * * *